US007127987B2

(12) United States Patent
Criss

(10) Patent No.: US 7,127,987 B2
(45) Date of Patent: Oct. 31, 2006

(54) TWO-PIECE DIE FOR SIMULTANEOUSLY CUTTING AND EMBOSSING

(75) Inventor: Michael R. Criss, Kansas City, KS (US)

(73) Assignee: W+D Machinery Company, Inc., Overland Park, KS (US)

( * ) Notice: Subject to any disclaimer, the term of this patent is extended or adjusted under 35 U.S.C. 154(b) by 0 days.

(21) Appl. No.: 10/914,553

(22) Filed: Aug. 9, 2004

(65) Prior Publication Data

US 2006/0027109 A1 Feb. 9, 2006

(51) Int. Cl.
*B41F 1/07* (2006.01)

(52) U.S. Cl. ..... 101/28; 101/3.1

(58) Field of Classification Search ..... 101/28, 101/30, 183.1, 4

See application file for complete search history.

(56) References Cited

U.S. PATENT DOCUMENTS

| | | | | | |
|---|---|---|---|---|---|
| 2,948,214 | A | | 8/1960 | Lotsch | |
| 4,307,972 | A | * | 12/1981 | Errichiello | 402/73 |
| 4,574,693 | A | * | 3/1986 | Fink et al. | 101/3.1 |
| 4,892,335 | A | * | 1/1990 | Taft | 283/75 |
| 4,974,983 | A | * | 12/1990 | Givati | 402/80 R |
| 5,054,389 | A | | 10/1991 | Kuhlman et al. | |
| 5,180,062 | A | * | 1/1993 | Stables | 206/574 |
| 5,181,464 | A | | 1/1993 | Kuhlman et al. | |
| 5,333,519 | A | * | 8/1994 | Holliday et al. | 76/107.8 |
| 5,476,336 | A | * | 12/1995 | Osiecki et al. | 402/79 |
| 5,511,472 | A | | 4/1996 | Taylor | |
| 5,582,102 | A | | 12/1996 | Holliday | |
| 5,597,256 | A | * | 1/1997 | Burton et al. | 402/4 |
| 5,647,260 | A | | 7/1997 | Nabity | |
| 5,722,319 | A | | 3/1998 | Hirano | |
| 5,778,748 | A | | 7/1998 | Beijen | |
| 6,000,722 | A | * | 12/1999 | Werner et al. | 281/29 |
| 6,220,136 | B1 | | 4/2001 | Benes et al. | |
| 6,499,903 | B1 | * | 12/2002 | Schwartz | 402/79 |
| 6,618,969 | B1 | * | 9/2003 | Rogers et al. | 40/124.16 |
| 2001/0001937 | A1 | | 5/2001 | Benes et al. | |
| 2002/0152868 | A1 | | 10/2002 | Benes et al. | |

* cited by examiner

*Primary Examiner*—Anthony H. Nguyen
(74) *Attorney, Agent, or Firm*—Kenneth W. Iles

(57) ABSTRACT

A two-piece die for simultaneously embossing a pattern into a web of material and cutting out that pattern from the web includes a flexible die member having male embossing patterns surrounded by a male die cutting edge. A base die member has female patterns into which the male patterns on the base die fit, but no corresponding groove for the male die cutting edge. The two members of the die set are held in a register by upper and lower outwardly projecting register tabs on the base die that are received into corresponding register slots in the flexible die and a register bar raised above the surface of the flexible die along side the register slots are on. An edge of the base die lying between the register tabs butts against the register bar. The die members, with a paper between them, are run through a flat bed press to produce embossed cut out patterns.

12 Claims, 8 Drawing Sheets

TWO-PIECE DIE FOR SIMULTANEOUSLY CUTTING AND EMBOSSING

CROSS-REFERENCE TO RELATED APPLICATIONS

Not Applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

The present invention is related to an apparatus for simultaneously embossing and cutting patterns from a web of material, such as paper. More particularly, the present invention is directly to a two-piece die set having mating male and female portions that can be used in a flat bed press.

Cutting the outline of a shape into a web of material using a razor blade die on a flat bed press is known as disclosed in, for example, U.S. Patent Application Publication Number U.S. 2002/0152868. It is also well-known to cut of a web of material to form various patterns, for example, the opening on a window envelope, using a rotary press.

Further, it is known to make an impression or to emboss a pattern into a web of material, such as paper, using a two-piece die having mating male and female design portions that are pressed together firmly with the paper between them to form the desired impression, as disclosed, for example in U.S. Pat. No. 5,181,464.

In many cases, after a pattern is embossed on a sheet of paper, the only portion of the paper of any interest or use to its creator is the portion having the embossed pattern on it. In this case, and in a second operation, the user will cut out the embossed portion from the sheet of paper. When many embossed patterns are involved, cutting each from a sheet of paper individually, or from many sheets of paper individually, is time-consuming, tedious, and invariably leads to cutout shapes of different sizes when performed manually. If the cutout shapes are formed prior to embossing, they typically will not be held in register by the embossing dies. If the cutout shapes are formed after embossing, the cutout shapes may not be in register with the embossed patterns. In any event, a second and demanding step is involved to achieve embossed patterns that are cut out from a sheet of material.

Therefore, it is desirable to cut out a shape of a perimeter around an embossed design during the actual pressing of the embossed design, and preferably simultaneously. Further, it is desirable to mass-produce such dies economically and quickly, indicating that a photochemically etched die would be preferable to a machine cut die.

Therefore, a need exists for a die that will simultaneously emboss a pattern on a portion of a web of material and cut out a perimeter shape around the embossed pattern; that maintains accurate register of the male and female portions of the die; and that can be mass-produced using photochemical etching; and that is easy to use.

BRIEF SUMMARY OF THE INVENTION

Accordingly, it is a primary object of the present invention to provide die that will simultaneously emboss a pattern on a portion of a web of material and cut out a perimeter shape around the embossed pattern.

It is a further object of the present invention to provide a die that maintains accurate register of the male and female portions of the die during pressing.

It is a further object of the present invention to provide a die that can be mass-produced using photochemical etching.

It is a further object to the present invention to provide a die that is easy to use These and other objects of the present invention are achieved by providing a two-piece die set having a relatively thick rigid base die member having female pattern grooves formed onto its inner face and a relatively thin flexible die member having male pattern ridges formed on its inner face such that the male pattern ridges mate with the female pattern grooves when the two die members are pressed together with their inner faces against each other. These portions of the die set emboss the desired pattern onto a web of material, such as a sheet of paper.

A male cutting die edge formed on the inner face of the flexible die member surrounds the male embossing die member. There is no corresponding female groove for the male cutting die edge to fit into. Rather, a flat crest of the male cutting die edge presses directly against the flat surface of the inner face of the base die member. This die system embosses the desired pattern into the sheet of material and simultaneously cuts out a separate pattern, typically outside of and surrounding the embossed pattern.

Because the male die edge does not fit into any corresponding groove, the two members of the die set will slide across one another, requiring a system to maintain the two dies in register. In the preferred embodiment, outwardly projecting parallel upper and lower register tabs are formed on one side of the perimeter of the base die and are received by corresponding upper and lower register slots along the corresponding side of the flexible die. A register bar projects upwardly from the inner surface of the flexible die along and adjacent to the side of the flexible die where the register slots are located. An edge of the base die that lies between the register tabs butt against the inner edge of the register bar, and is held there by clamping forces generated by end tabs on the register tabs that engage the outer edge of the register bar. An alternative embodiment employs flat register tabs and upwardly projecting pins located on the flexible die that are received in corresponding apertures on the base die.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
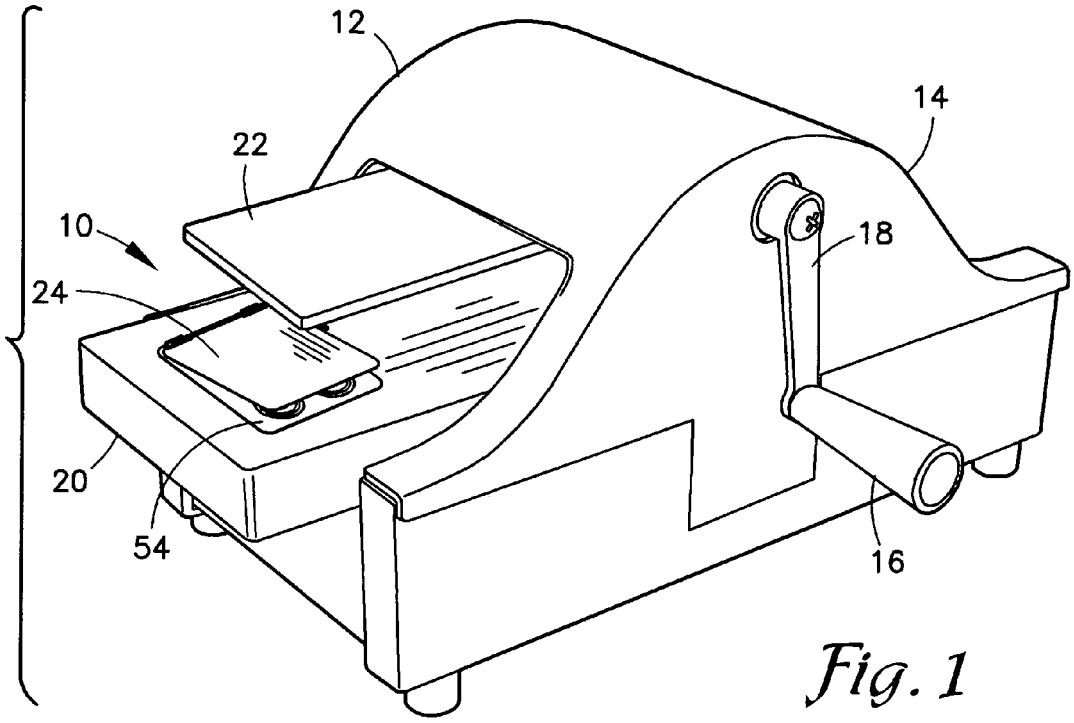
FIG. 1 is an isometric view of a table-top hand-operated press suitable for use with a two-piece die for simultaneously embossing and cutting according to the present invention, showing the two-piece die for simultaneously embossing and cutting in position for use on the bed of the press.

Referring to FIG. 1, a two-piece die for simultaneously embossing and cutting, two-piece die 10, according to the present invention can be suitably used in any table-top hand-operated press 12, which may also be electrically operated, having a housing 14 and a handle 16 utilized to turn a crank 18, rotating gears, and hence upper and lower rollers, to rotate in opposite directions, thereby drawing the bottom mat 20 between the internal rollers with the two-piece die 10, with paper or the like between the die members, sandwiched between the rigid bottom mat 20 and a resilient flexible embossing mat 22. The rigid bottom mat 20 may conveniently be a thick sheet of plastic and the embossing mat 22 may conveniently be a sheet of foam material or a sheet of plastic, and, like the press 12, are well known in the art. When a sheet of paper or other web material is placed between the two members of the two-piece die 10, and is drawn through the press 12, the patterns formed on the die are simultaneously embossed with a particular design and an outer perimeter around the design is severed from the web of paper. Any type of press having a flat bed can be utilized with the two-piece die 10, so long as it generates the requisite force and pressure on the two-piece die 10, which is easily achieved by the press 12 for a two-piece die 10 approximately 5.5 cm×5.5 cm (2.25 in×2.25 in) having die portions as shown.

Figure 4:
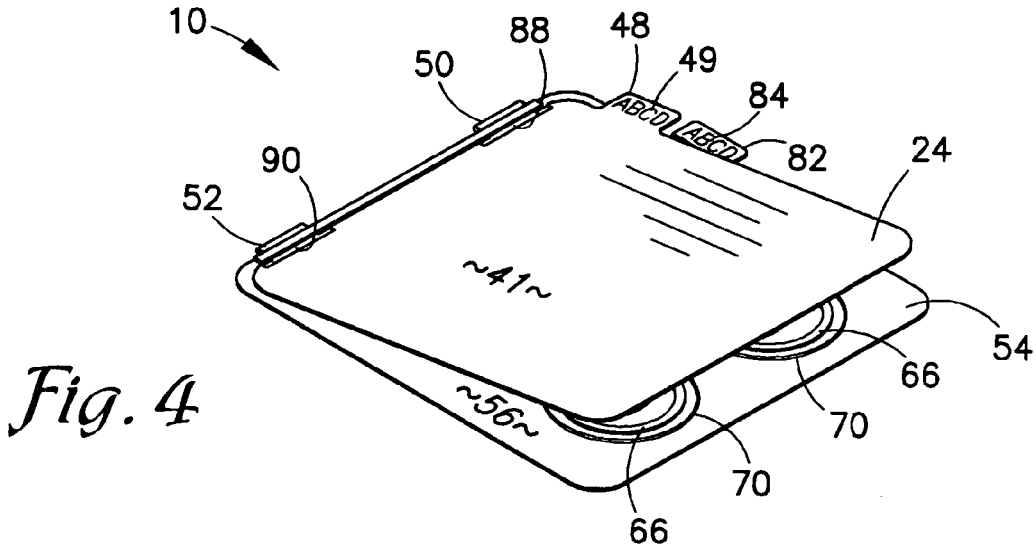
FIG. 4 is an isometric view of die of FIG. 1 shown in its assembled position ready for use and illustrating and the two sections of the die in their natural equilibrium position.
Figure 5:
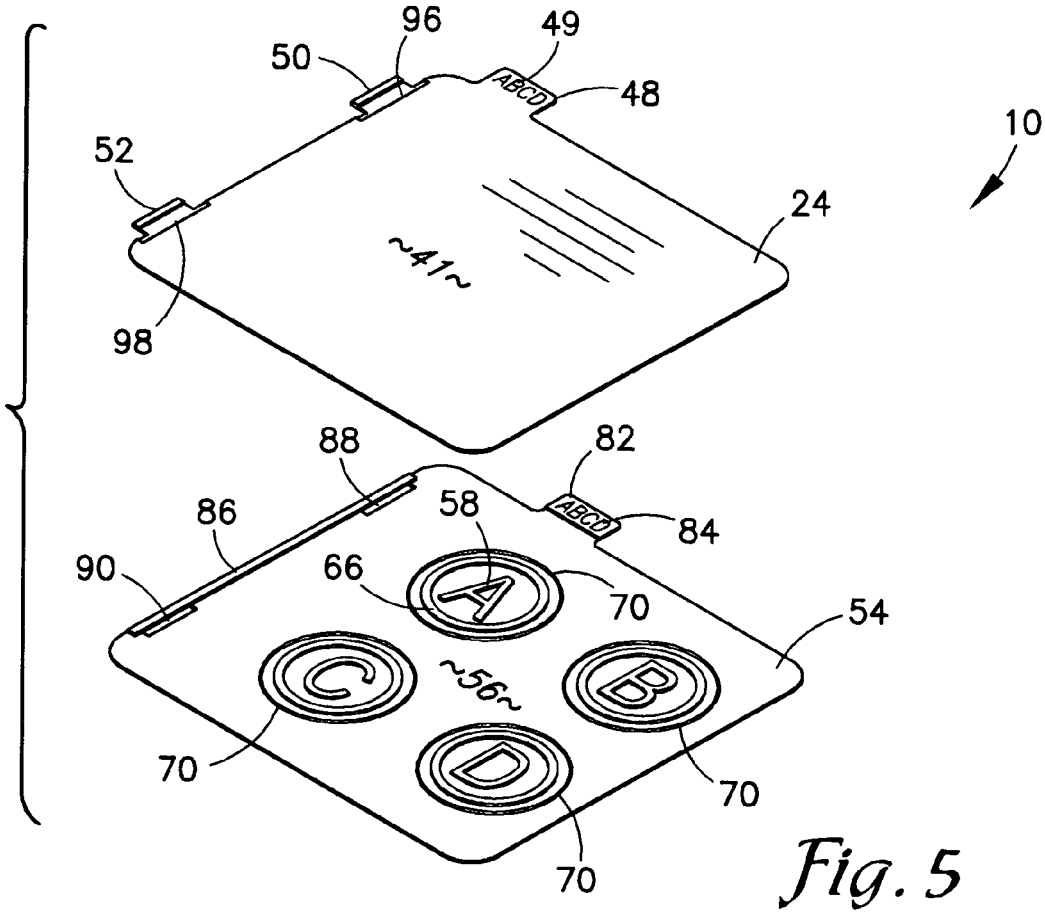
FIG. 5 is an exploded view of the die of FIG. 1, emphasizing the register system on the left-hand side of each die.
Figure 7:
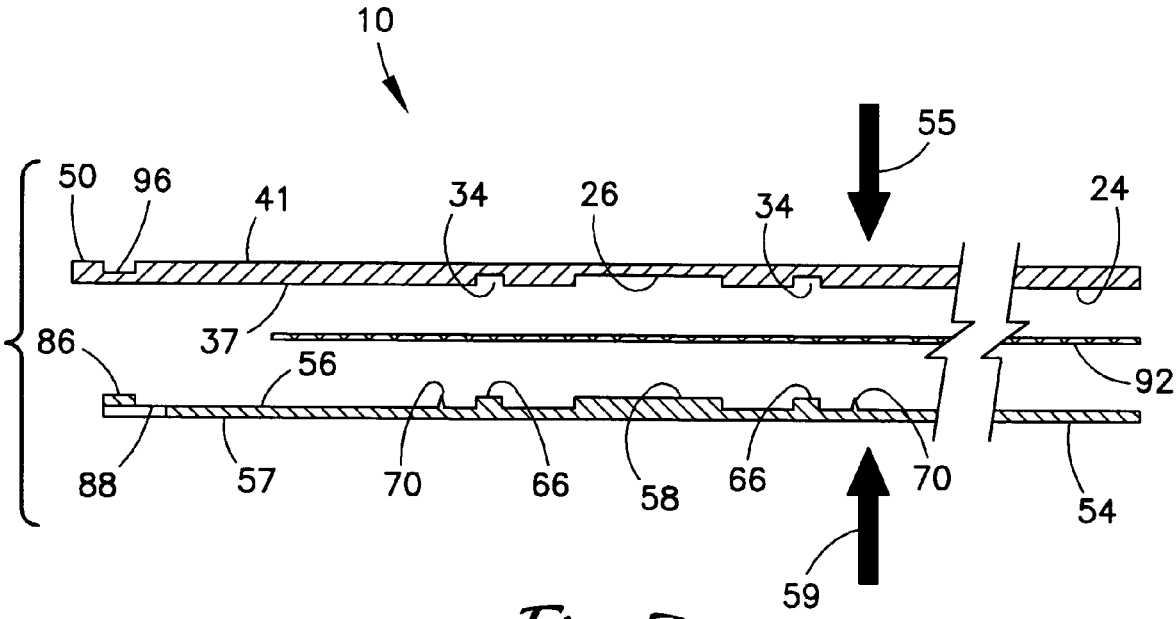
FIG. 7 is a sectional view taken along lines 7—7 of FIG. 6.

The term "female" means a feature that is recessed relative to the general plane of the die face. The term "male" means a feature that is in relief, that is, that projects upwardly from the general plane of the die face. The term left, or left-hand side refers to the left side of the two-piece die 10 as shown in FIGS. 4, 5, that is, the side of the two-piece die 10 having a register system and the term right or right-hand side refers to the right-hand side as shown in FIGS. 4, 5, 7, that is, the side that does not have a register system. More generally, left and right refer to the sides of the drawing sheets. Either side of the two-piece die 10 may be placed on the press 12 as the top side, but, since the base die 24 naturally springs open a little when the two dies are assembled and a web material will be inserted between them, it is more convenient to the user to consider the base die 24 as the top member in use and in discussion.

Figure 2:
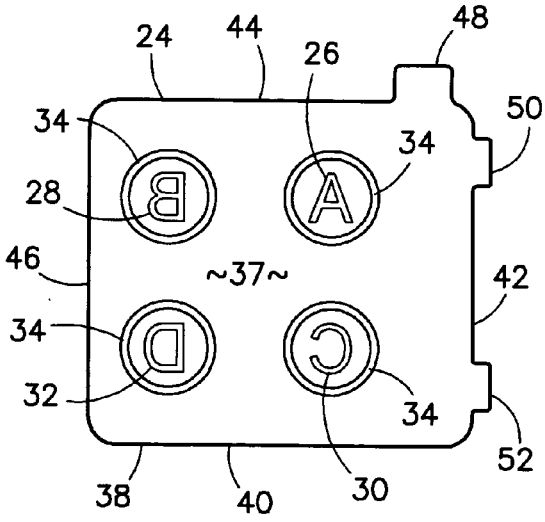
FIG. 2 is a rear view of the female die of FIG. 1.

Referring to FIG. 2, the base die, that is the top die 24 as shown in FIG. 1, includes a female portion embossing dies, including the female die portions, that is, female letter A 26, female letter B 28, female letter C 30 and female letter D 32, each encircled a female circular band 34. The base die 24 includes a flat face 37 into which the female letters are recessed. The base die 24 further includes a perimeter 38 having a bottom edge 40 and left-hand edge 42 a top edge 44 and a right hand in edge 46, each connected to the adjoining to the edges and defining basically a square pattern having a squared off outwardly and upwardly projecting index tab 48 along the top edge 44, which carries indicia of the patterns that the dies will make, but on the face of the index tab 48 that is not visible in FIG. 2. The base die further includes an upper register tab 50 and a lower register tab 52, both projecting outwardly from the left-hand edge 42 and each being identical in dimensions and having an outer perimeter consisting of three sides of a rectangle. The register tabs 50, 52 form part of a register system described below.

Figure 3:
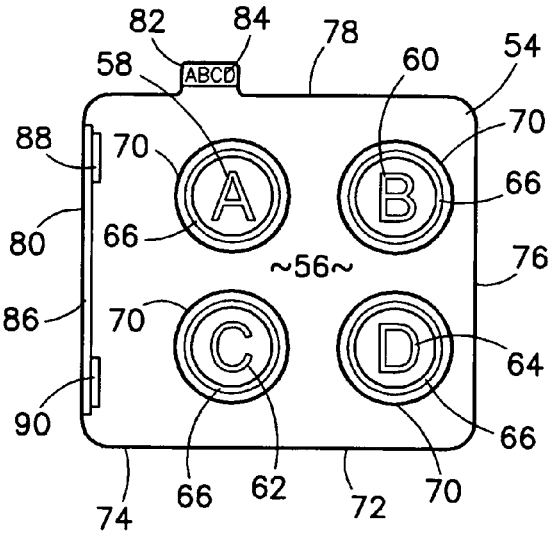
FIG. 3 is a front view of the male die of FIG. 1.

Referring to FIG. 3, the flexible embossing die, or bottom die 54, having a flat face 56, with male or relief letters raised above it, which are the male letter A 58, the male letter B 60, the male letter C 62 and the male letter D 64. Each letter is individually surrounded a male circular band 66. Surrounding each male circular band 66 is another circle, which is a male cutting die edge 70. There is no corresponding groove or female portion on the base die 24 that the male cutting die edge 70 fits into. The embossing die 54 includes a perimeter 72 formed by a bottom edge 74, a right-hand edge 76, a top edge 78 and a left-hand edge 80, defining basically a square perimeter 72. Along the top edge 78, for a short length of the top edge 78, and an indexing tab 82 projects upward from the top edge 78 includes identifying indicia 84, which are small pictures of the design, pattern or letters that the two-piece die 10 will emboss when used, such as the letters ABCD shown. The ABCD and circular band designs described here are clearly for illustration only and any desired embossing design of any size can be utilized by the two-piece die 10.

Still referring to FIG. 3, along the left-hand edge 80 is a register system that includes a register bar 86 that is raised relative to the face 56 of the flexible die 54 and lies along and inwardly of the left-hand edge 80, is rectangular in shape when viewed from the front, and runs along most of the left-hand edge 80 and includes a left-hand edge that is congruent with the left-hand edge 80 of the flexible die 54. Adjacent to the register bar 86 and inward from the left-hand edge 80 of the flexible die 54 is an upper register slot 88 and a lower register slot 90. The base die 24 is slightly smaller in surface area than the flexible die 54 to facilitate the separation and assembly of the two-piece die 10 for the convenience of the user. The register system can be placed along any edge of the dies, which may be of any desired shape, e.g., rectangular, square, triangular, and so forth. The register system is preferably along the left-hand edge because it then opens and closes in the same familiar fashion as a book opens and closes.

Figure 6:
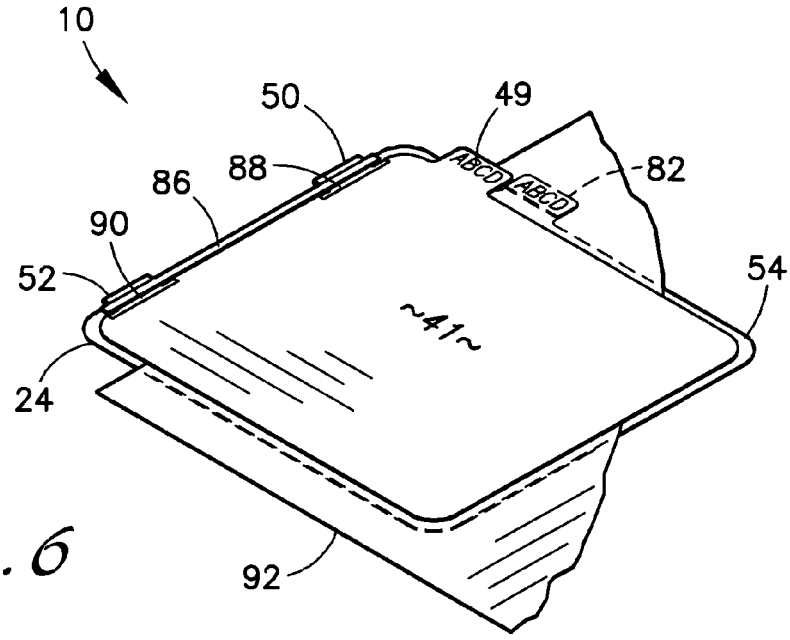
FIG. 6 is an isometric view showing the die of FIG. 1 ready for use with a sheet of paper inserted between the two members.

Referring to FIGS. 4, 5, 6, the two-piece die 10 is conveniently assembled by placing the base die 24 above the flexible die 54 with the base die 24 at an angle of 15°–110°, sliding the upper and lower register tabs 50, 52 into the corresponding register slots 88, 90 on the flexible die (FIG. 9) respectively as indicated by the arrows 95 and closing the two-piece die 10 by pushing the base die 24 and the flexible die 54 together. The natural equilibrium position of the two die members 24, 54 is shown in FIG. 4, that, is, the two-piece die 10 members 24, 54 naturally remains open a bit.

Figure 10:
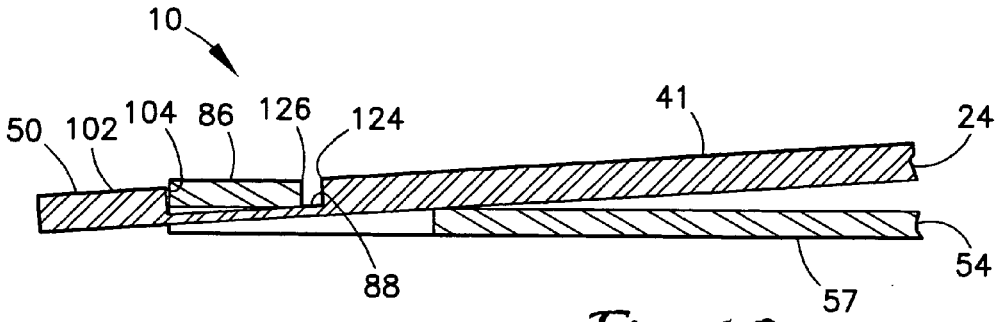
FIG. 10 is an enlarged cross-section of the assembled dies set as shown in FIG. 4.
Figure 11:
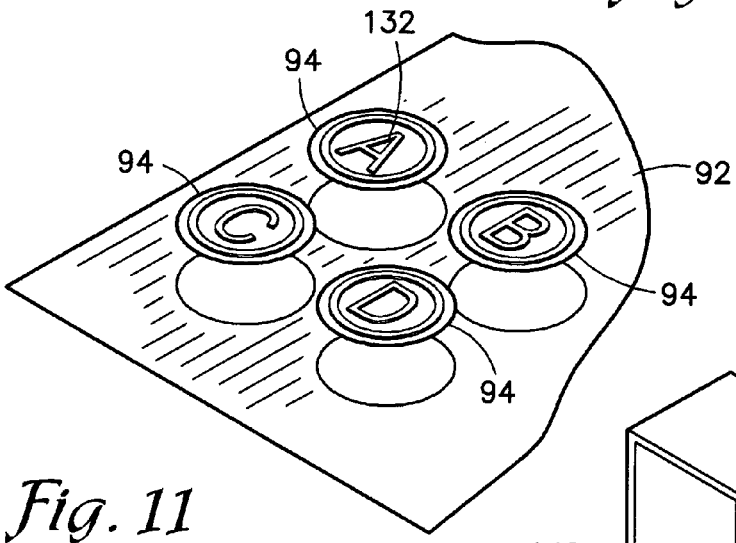
FIG. 11 is a fragmentary isometric view of a web of paper illustrating the end products that are formed by the die set of FIG. 1, showing in space above the paper.
Figure 12:
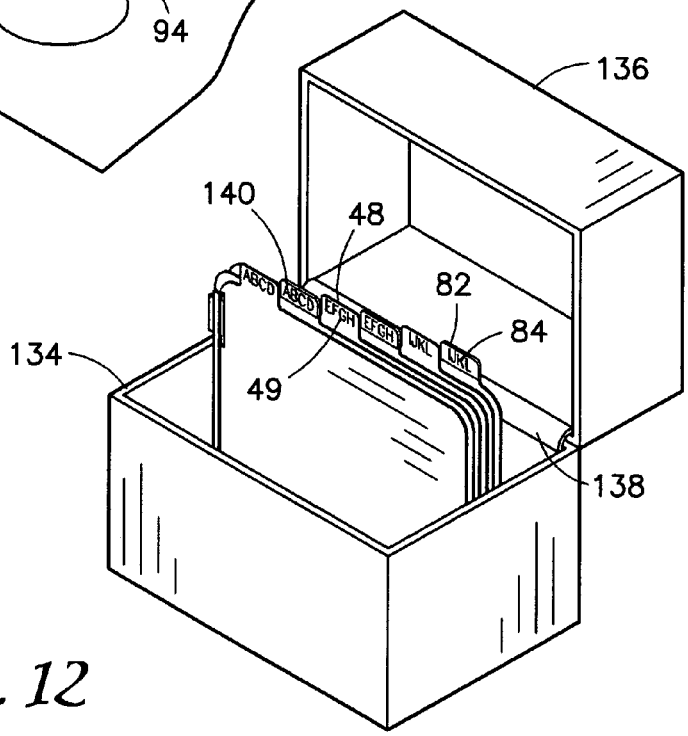
FIG. 12 is an isometric view of a storage box containing a portion of a set of two-piece dies of FIG. 1 illustrating the arrangement of die sets for easy retrieval and use.

To use the two-piece die 10, a sheet of paper 92 or other web material to be embossed and cut is inserted between the base die 24 and the flexible die 54 as shown in FIG. 6 and the two-piece die 10 is flattened and pressed in the press 12. After pressing, the two-piece die set 10 is removed from the press 12 and opened, releasing the cut and embossed shapes 94 (FIG. 11). The index tab 48 on the base die 24 carries indexing indicia 49 when, that are the same as the indexing indicia 86 on the flexible die 54, allowing users to match corresponding dies quickly and to file numerous dies in a logical order in a file box (FIG. 12), since the spacing of the index tabs for different related die sets 10 are staggered along the top edge of different set of the two-piece die 10 for making different impressions, for example, all alphanumeric characters are presented in a series of die sets, each having four characters. The base die 24 includes a flat smooth front face 41 and the flexible die 54 includes a flat smooth rear face 57 (FIG. 10).

Referring to FIG. 7, the cutting male cutting die edge 70 projects upwardly from the flat face 56 of the flexible die 54 by exactly the same height as the male letters and does not fit into any corresponding groove or recess in the base die 24, but rather simply butts against the flat face 37 of the base die 24. In ordinary male-female embossing dies of the prior art, no particularly precise register system is needed to register the two dies because the male designs fit exactly inside their corresponding female designs, making embossing dies essentially self-registering. In the present case, however, because the male cutting die edge 70 rises above the plane of the die face 56 but does not fit into any corresponding groove, the base die 24 and the flexible die 54 will slide almost freely over one another when they are pressed together. Therefore, a system for positively holding the base die 24 and the flexible die 54 together in register is required. Further, because the assembled two-piece die 10 with a flexible web member 92 between the two die members will be fed into a press, the upper surface of the assembled die must not include any projections that rise above the general plane of the top surface 41 of the base die 24. Similarly, nothing can project downward from the general plane of the smooth flat rear face 57 of the flexible die 54 because any such projections would result in uneven force and pressure on the dies 24, 54, resulting in poor or uneven embossing or cutting or both. The register system described in more detail below solves this problem and meets these criteria. The two dies 24, 54 will be pressed together in the press 12 by the downward forces shown by the arrow 55 and the upward forces shown by the arrow 59. Either the base die 24 or the flexible die 54 may be the top die when the two-piece die set 10 is pressed in the press 12.

Prior to development of the present invention, it was not known that a photochemically etched two-piece die could cut out a design from a web of material-on the contrary, it was believed that this could not be done, despite a perceived need for such a tool by some businesses. Mechanical cutting operations in the printing or die cutting steps of a material handling process are universally performed by machine sharpened cutting blades, not photochemically etched dies. During development of the two-piece die 10, the inventor conducted many experiments for different designs. In general, the designs attempted to mimic the actual shearing and cutting action of a two-blade cutting system, such as scissors. This led to the use of a matching female groove in the base die 24, into which the male cutting die edge 70 fit. Numerous experiments showed that any cutting was erratic with perhaps one portion of a circle cut sometimes and not other times and other portions of a circle not cut at all and with uneven embossing. In an effort to more closely approach the actual cutting action of, for example scissors, the mating female groove was made narrower and narrower in progressive experimental prototypes. Eventually, the mating female groove became so narrow that the light used to expose the photo chemical mask refracted around the masked off portion that was to become the groove, resulting in no female groove for the male cutting die edge 70 to fit into. It was found that this version worked best, consistently cutting even patterns and into the web material 92 and simultaneously embossing a pattern inside the cutout portion.

In particular, in Prototype Number 1, the first test pieces used 0.64 mm (0.025 in.) thick material for the dies. The intention was to create a cutting blade and mating groove for the blade with a close enough fit that the paper material would be cut by shearing action. The groove gap for the cutting blade measured 0.82 mm (0.102 in.), and the depth of the groove was approximately 0.45 mm (0.018 in.) deep. The cutting blade was 0.088 mm (0.0035 in.) wide. With this prototype, the embossing functions was performed satisfactorily but the cutting portion of the dies did not work.

In Prototype Number 2, the dies were made from 0.64 mm (0.025 in.) thick material. The groove gap for the cutting blade measure 0.58 mm (0.023 in.) and the depth of the groove was approximately 0.37 mm (0.015 in.). The cutting blade was 0.088 mm (0.0035 in.) wide. Results using Prototype Number 2 were that the cutting portion of the dies started to sever the paper, but the edges of the paper appeared torn, not cut and were not uniformly cut. Some portions of the design along the cutting die were not cut at all and the embossing was deeper and some portions of the embossed pattern than in others.

Prototype Number 3 was made from 0.64 mm (0.025 in.) thick material. The groove for the cutting blade measured 0.15 mm–0.51 mm (0.006–0.020 in.). The depth of the groove was approximately 0.1 mm–0.3 mm (0.004 in.–0.012 in.). The cutting blade measured 0.088 mm (0.0035 in.) wide. Products made from Prototype Number 3 resulted in articles with rough cutting that appeared torn, not cut. The groove was narrow enough that accurate dimensions could not be well maintained and had a lot of variance in the width.

Prototype Number 4 was also made from 0.64 mm (0.025 in) thick material with a grove gap for the cutting blade that measured 0.0–0.45 mm (0.000–0.018 in) and the depth of the groove was approximately 0.0–0.25 mm (0.00–0.010 in).

The cutting blade measured 0.088 mm (0.0035 in) wide. When Prototype Number 4 was used, embossing was satisfactory and cutting was satisfactory where the groove measured 0.00 mm, but where the groove measured more than 0.00 mm, the cutting was still rough, uneven and when cut, the paper appeared to have been torn. This result indicated that perhaps the best cutting would be obtained without any groove for the cutting blade to fit into.

Prototype Number of 5 was made from 0.64 mm (0.025 in.) thick material and the groove for receiving the cutting blade was entirely removed for this test. The cutting blade measured 0.05 mm (0.002 in.) wide. Prototype Number 5 provided clean cuts throughout the entire perimeter of the male cutting blade and did not produce any edges that appeared to have been torn from the material.

Prototype Number 6 was made from 0.508 mm (0.020 in.) thick material. The cutting blade that measured 0.05 mm (0.002 in.) wide and again, no mating groove was provided for the male cutting blade. Using Prototype Number 6, the embossing became cleaner, crisper and better defined; the cutting blade width is more uniform throughout the length of the cutting blade and dies made according to Prototype Number 6, can be used in pressing machines designed for use with 0.032 in. thick cutting dies, a conventional die thickness for small presses such as the press 12.

Now, however, instead of having two blades that slide past each other to shear the material as scissors do, or a blade and an opposing anvil that a blade slides past to shear the web material, the male die cutting edge 70 will simply be pressed very hard directly against the hardened steel sheet of the mating die. It was found that any type of conventionally sharpened blade, that is, a blade having a beveled edge or edges that lead to a sharp edge, very quickly become dull in this application. Further investigation determined that the male die cutting edge 70 does not actually cut, that is, shear and sever the fibers in the web 92, as a shear or scissors would do, but rather crushes the fibers so forcefully that they separate and are displaced toward either side of the male die cutting edge 70 so that the shape is severed from the web of material 92. From this discovery, it was determined that a blade having a relatively wide flat smooth plateau top or crest 71 provides long-lasting cutting action.

Figure 13:
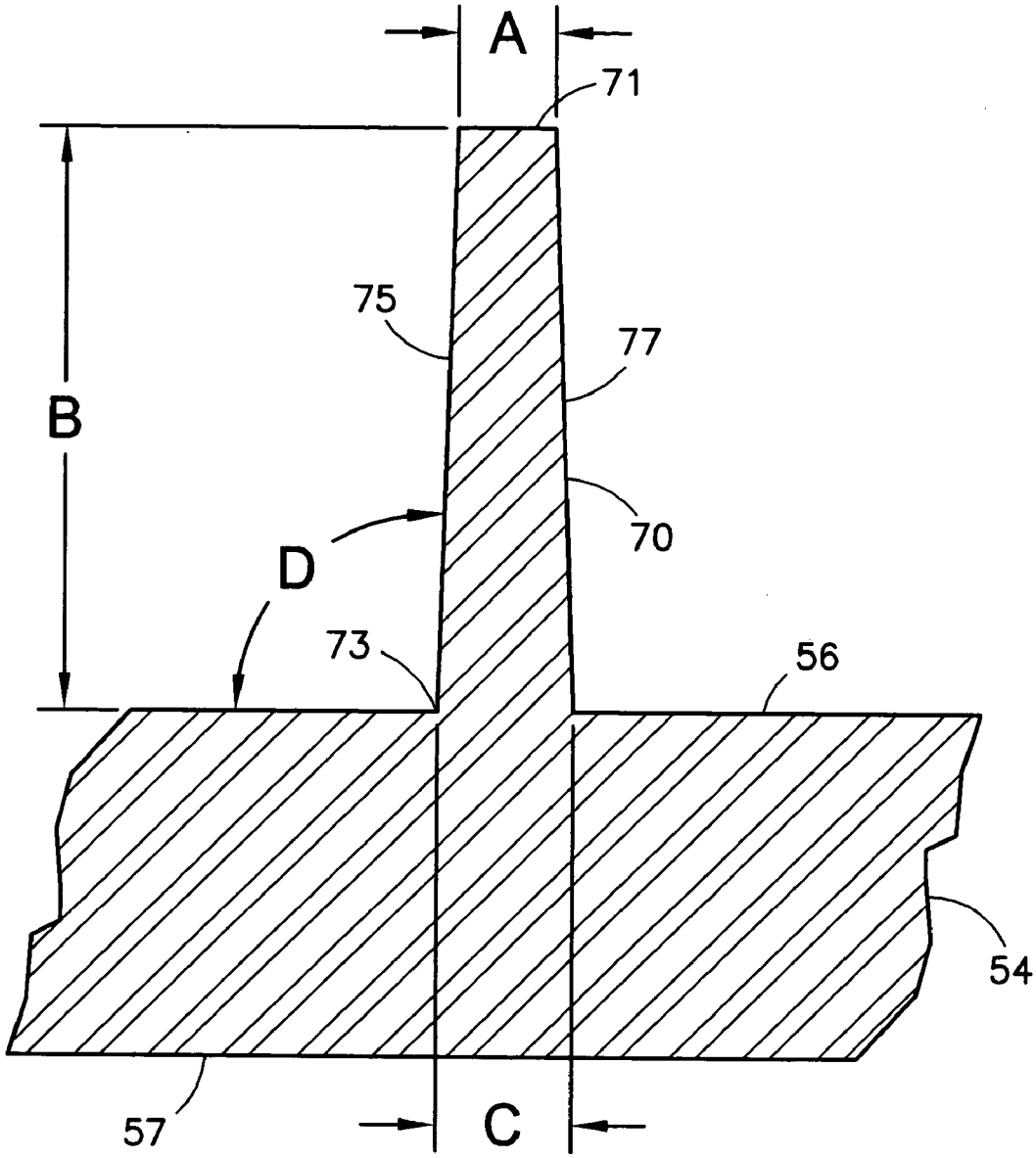
FIG. 13 is a greatly enlarged cross section of the cutting die portion of the die of FIG. 1.
Figure 14:
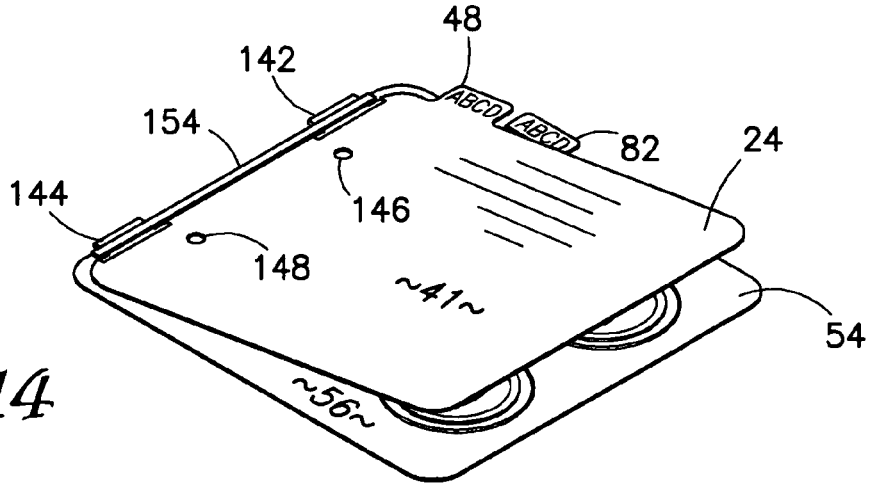
FIG. 14 is an isometric view of an alternative embodiment of the die of FIG. 1 show it in this emboldened position on a ready for use and illustrating and the two sections of the die in their natural equilibrium position.
Figure 15:
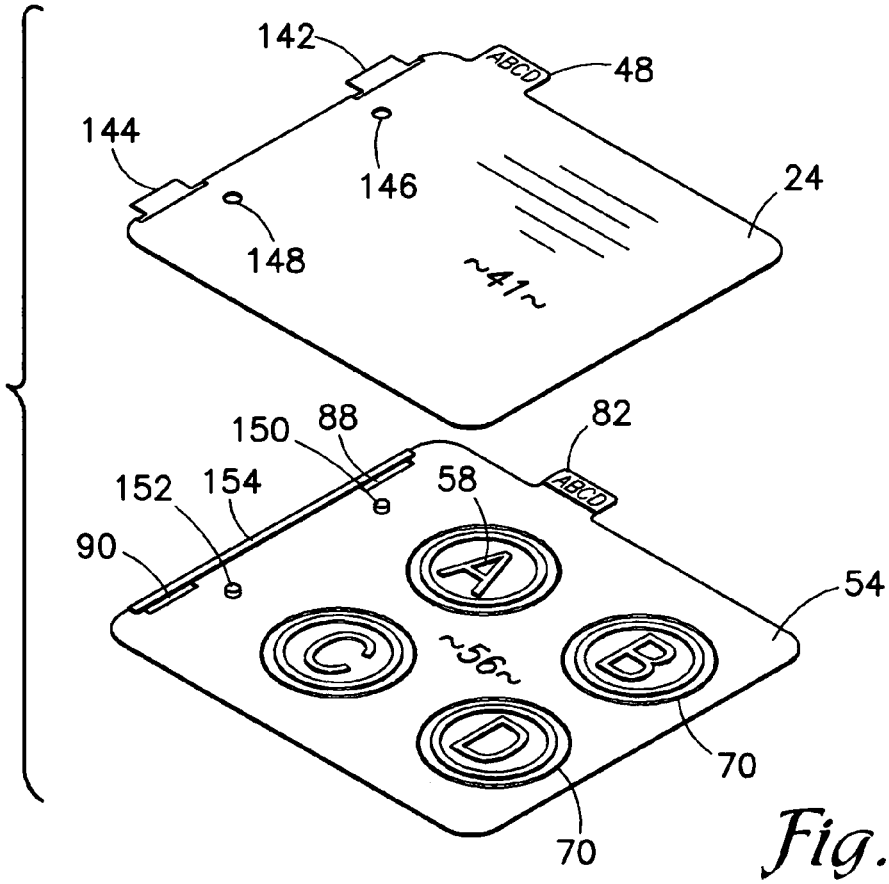
FIG. 15 is an exploded view of the die of FIG. 14, emphasizing the register system on the left-hand side of each die.
Figure 16:
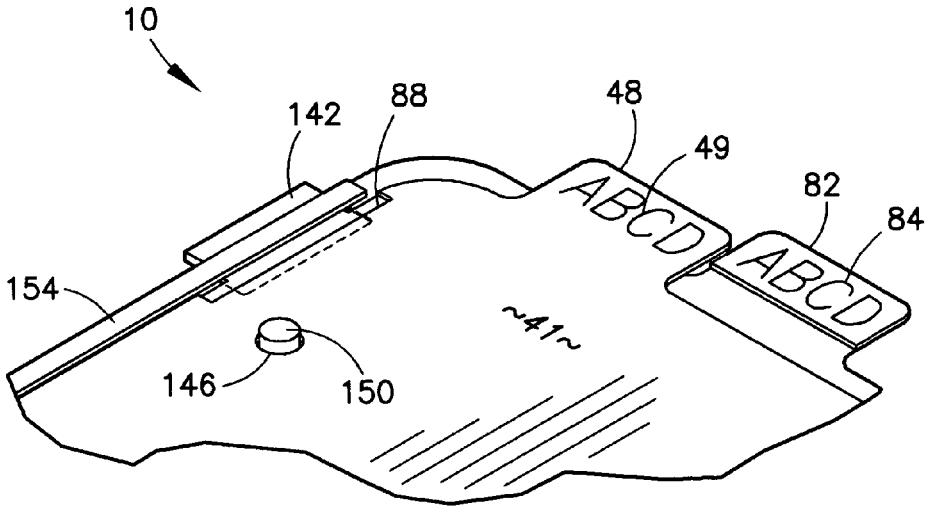
FIG. 16 is a fragmentary isometric view illustrating the die register system and index-tab system of the die of FIG. 14.
Figure 17:
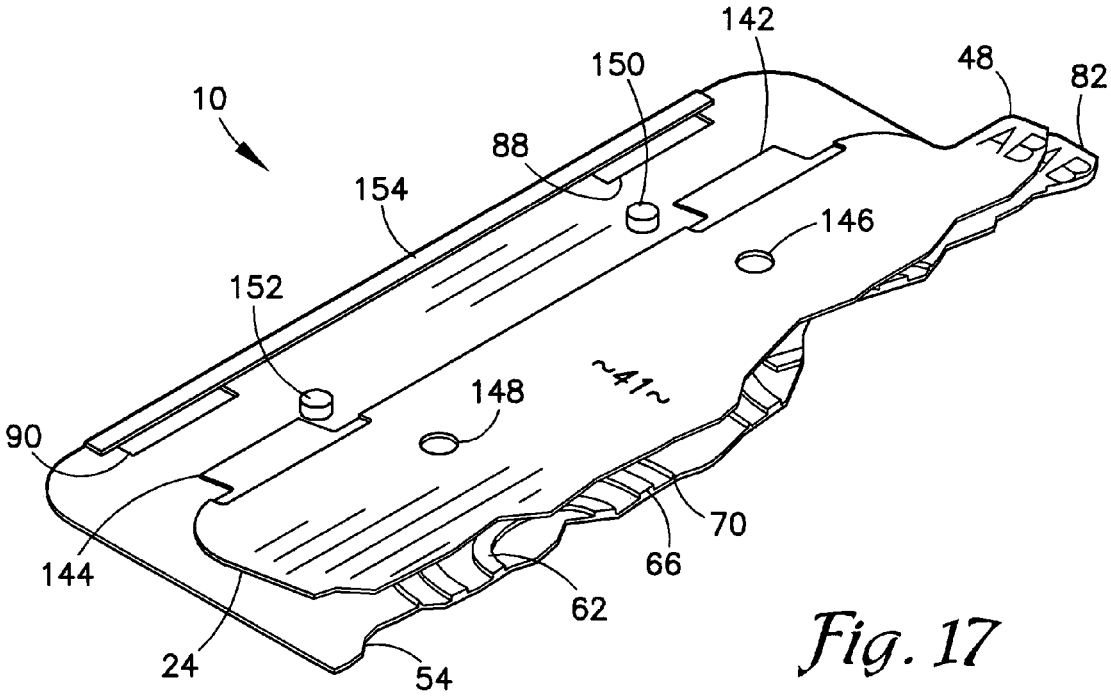
FIG. 17 is an enlarged a fragmentary isometric view illustrating the die register system and index-tab system of the die of FIG. 14.

These investigations have led to the development of the male cutting die edge 70 as shown in FIG. 13, which has a flat upper surface, i.e., a plateau, or crest 71 having a width A in a range of 0.025 mm–0.08 mm, with the preferred width being 0.05 mm. Further, the male cutting edge 70 has a left-hand side slope 75 and a right-hand side slope 77 that rise from the flat face 56 of the flexible die 54 symmetrically at an angle D lying in a range of 90°–110°, with the preferred angle D being 95°. The height B of the male cutting die 70, above the inner surface 56 lies and a range of 0.01 mm–0.5 mm, with the preferred height being 0.3 mm, which, of course, must be the same as the height of the male embossing portions of the die. The width of the root or base portion C of the male cutting die edge 70, ranges from about 0.04 mm–0.010 mm, with the preferred width being about 0.07 mm. A male cutting die edge 70 just described provides consistently clean and dependable cuts throughout the entire perimeter of defined by the male cutting die edge 70 and has proven very durable in lengthy tests, while allowing simultaneously formed clean and uniform embossing of a design enclosed by the male cutting die edge 70. Thus, the male cutting die edge 70 exhibits the cross sectional shape of a triangle truncated along its top or upper portion. The two sides 75, 77 slope upwardly and inwardly toward one another.

Figure 8:
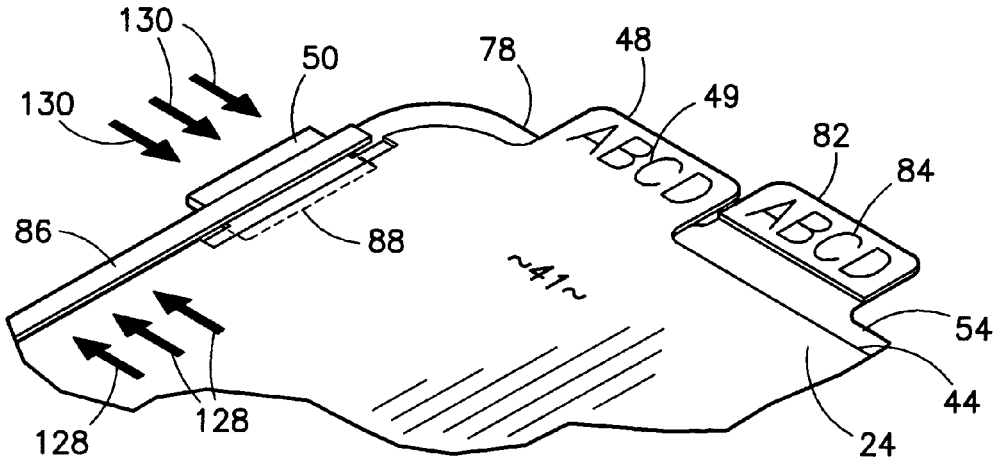
FIG. 8 is a fragmentary isometric view illustrating the die register system and index-tab system of the die of FIG. 1.
Figure 9:
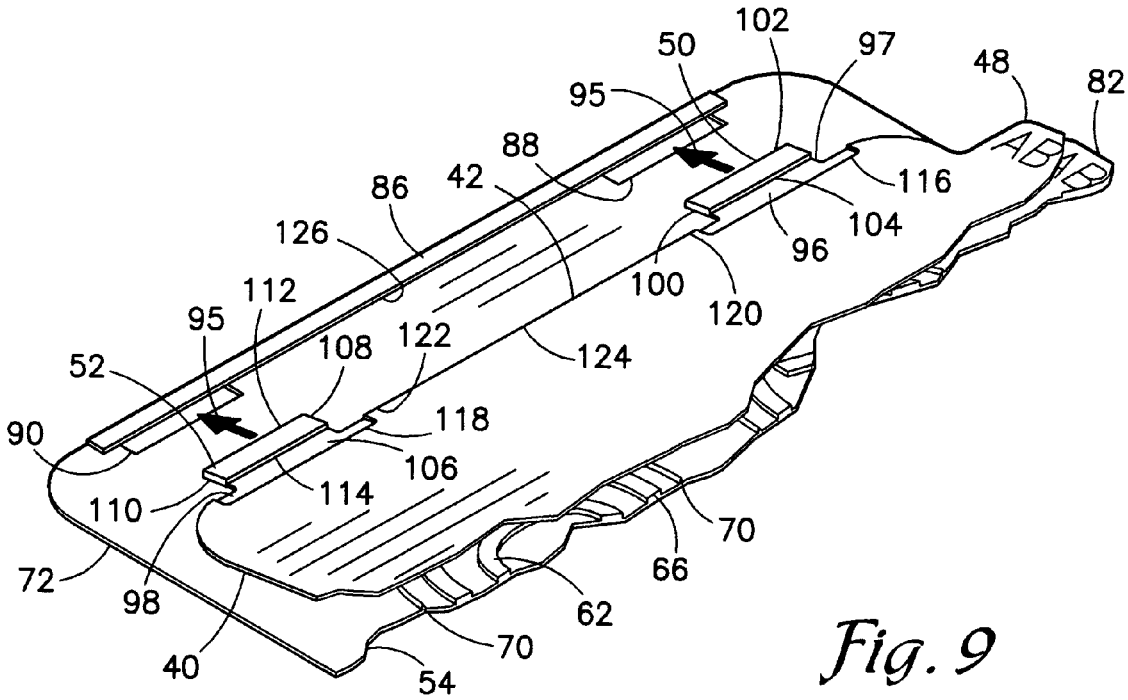
FIG. 9 is an enlarged a fragmentary isometric view illustrating the die register system and index-tab system of the die of FIG. 1.

Referring to FIG. 9, the upper register tab 50 includes a longitudinal channel 96, which runs from the top edge 97 of the upper register tab 50 to the bottom edge 100 of the upper register tab 50, resulting in a corresponding upstanding left-hand side lip 102 having a straight right-hand edge 104. Similarly, the lower register tab 52, which is identical to the upper register tab 50, includes a longitudinal channel 106, which runs from the top edge 108 of the lower register tab 52 to the bottom edge 110 of the lower resister tab 52, resulting in a corresponding upstanding left-hand side lip 112 having a straight right-hand edge 114. Adjacent to the upper register tab 50 and to the right of it lies a hinge recess 116 that runs along the width of the upper register tab 50 somewhat beyond it both above and below the upper register tab 50. A corresponding lower hinge recess 118 runs along the width of the lower register tab 52 and somewhat beyond it both above and below the lower register tab 52. The cut away recesses forming the upper and lower hinge recesses 116, 118 define the upper and lower ends 120, 122 respectively of a straight left-hand register edge 124 on the flexible die 54, with the hinge recesses 116, 118 facilitating closure of the two-piece die 10. When the register tabs 50, 52 are slid into the corresponding register slots 88, 90 respectively, left-hand register edge 124 butts against the right-hand edge 126 of the register bar 86, while the straight right-hand edges 114, 124 of the register tabs 50, 52 butt against the left-hand edge 126 of the register bar 86. The width of the register slots 88, 90 are substantially the same as the width of the register tabs 50, 52. The fit of these elements is tight, resulting clamping forces along the opposing arrows 128, 130 in FIGS. 8 that clamp the register bar 86 between the straight left-hand register edge 124 of the base die 24 and the upper and lower lips 102, 112 of the upper and lower register tabs 50, 52, respectively, insuring that the base die 24 and the flexible die 54 remain in register. The positions of the register elements could be changed to another side of the two-piece die 10, or the parts could be formed onto the other die member, that is, the register slots could be in the base die and so forth.

Referring to FIGS. 14–17, there is shown an alternative embodiment of the two-piece die 10 in which the cutting and embossing dyes are those disclosed above, but the register system is different. An upper register tab 142 and a lower register tab 144 on the base die 24 slide in two corresponding register slots, upper register slot 88 and lower register slot 90 on the flexible die 54 and the left hand edge of the base die 24 butts against the inside edge of a low-profile register bar 154, which is much thinner than the register bar 86 previously described. A principal difference between this embodiment and the register system described-above, is that the upper and lower register tabs 142, 144, respectively are entirely flat throughout their surface area, that is, they do not include any type of lip or channel.

Still referring to FIGS. 14–17, a pair of spaced apertures, upper register aperture 146 and lower register aperture 148, about 4 mm in diameter are formed in the base die 24 about 3 mm from the left-hand edge, and receive a corresponding upper register pin 150 and lower register pin 152, both of which project upwardly from the flat face 56 of the flexible die 54 when the base die 24 and the flexible die 54 are assembled and in register. The register pins 150, 152 help stabilize the register of the dies 24, 54 when received by the corresponding register apertures 146, 148. Naturally, any desired number of register pins and apertures can be utilized.

The embodiment illustrated in FIGS. 1–10 is the preferred embodiment and is the best mode known to the inventor for carrying out his invention. The embodiment shown in FIGS.

14–17 does not work as well for three reasons. First, the register pins 150 and 152 tend to disengage from the register apertures 146, 148 when a paper or other web material is slipped between the two dies. Second, the dies in every case are preferably made from hardened sheet steel that is photochemically etched. Photochemical etching is not sufficiently precise to provide the desired snug fit between the register pins 150, 152 and the corresponding register apertures 146, 148. Sometimes the fit is too tight and sometimes it is too lose. Finally, because there is no lip or channel on the register tabs 142, 144, there are no clamping or pinching forces on the register bar 154, that is, no force holding the left-hand edge of the base die against the register bar 154, allowing the two dies 24, 54 to slip relative to one another. While the alternative embodiment shown in FIGS. 14 to 17 performs well and its performance can be enhanced by securing the left-hand edges of the two-piece die together, this embodiment does not provide the high-quality consistent end products that the preferred embodiment does and users find the use of tape to hold the two dies together aesthetically unpleasing.

Although a two-piece die 10 according to the present invention could be made from machined material, it is preferable to manufacture the two-piece die 10 from hardened sheet steel that is photochemically etched. The base die has a thickness in the range of about 0.3–0.7 mm, with the preferred thickness being 0.5 mm (0.0200 in.). The flexible die has a thickness within a range of 0.05 mm to about 0.4 mm, with the preferred thickness being 0.2 mm (0.0078 in.). These thicknesses are the dimensions of the final product, that is, after the hardened sheet steel has been photochemically etched. The flexible die 54 bends under pressure to force the embossing and cutting die ridges into the corresponding female grooves of the more rigid base die 24. It is believed that the male cutting die edge 70 clamps the paper 92 between the two dies, forming a circle, in the case illustrated in the Figs., that is effectively a smaller web and die set defined by the male cutting die edge 70 and that the flexible die 54 is sufficiently flexible that within the perimeter of the male cutting die edge 70 that the male embossing pattern is depressed into the mating female embossing pattern cavity. In any event, the plain result is that the paper 92 is cut and embossed simultaneously.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A die set comprising:

a. a base die;

b. a flexible die; and c. means for registering said base die and said flexible die comprising an upper register tab and a parallel lower register tab, each projecting outwardly from said base die along a first side of said base die and corresponding upper slot on a first side of said flexible die for receiving said upper register tab and a corresponding lower slot on said first side of said flexible die for receiving said lower register tab.

2. A die set in accordance with claim 1 further comprising a raised register bar formed on said flexible die along said first side of said flexible die and that abuts said first side or said base die when said base die and said flexible die are assembled to form a die set.

3. A die set in accordance with claim 2 wherein said raised register bar further comprises a left-hand edge congruent with said first side of said flexible die and an inner edge parallel to said first side of said base die.

4. A die set in accordance with claim 1 wherein said upper register tab has an outer perimeter defining three sides of a rectangle projecting outwardly from said left-hand side of said base die and said lower register tab has an outer perimeter defining three side of a rectangle projecting outwardly from said left-hand side of said base die.

5. A die set in accordance with claim 1 further comprises a raised register bar wherein said raised register tab and said upper slot and said lower slot are the same width.

6. A die set in accordance with claim 1 further comprising an upper hinge recess adjacent to said upper tab on said base die and a lower hinge recess adjacent to said lower tab on said base die.

7. A die set in accordance with claim 1 further comprising an upper longitudinal channel formed in said upper register tab adjacent to a left-hand side of said base die and a lower longitudinal channel formed in said lower register tab adjacent to said left-hand side of said base die.

8. A die set in accordance with claim 1 further comprising an upstanding lip on an outer end of upper register tab and an upstanding lip portion on an outer end of said lower register tab.

9. A die set in accordance with claim 1 further comprising an upper aperture and a lower aperture formed in said base die and an upper upstanding pin and a lower upstanding pin formed on an inner surface of said flexible die and said at least one aperture formed in said base die for receiving said upstanding pin with said upper and lower upstanding pins being inserted into said upper and lower apertures respectively when said base die and said flexible die are aligned and closed.

10. A die set in accordance with claim 1 further comprising an index tab projecting upwardly from a top edge of said base plate and parallel to a general plane of said base plate.

11. A die set in accordance with claim 3 further comprising a length of a side of said base die that engages and presses against said inner edge of said raised register bar parallel to said first side of said flexible die of said register bar when said base die and said flexible die are connected together by inserting said upper and lower tabs into said upper and lower slots respectively and are pressed together.

12. A die set comprising:

a. a base die further comprising an upper register tab projecting outwardly from a left-hand side of said base die and a lower register tab projecting outwardly from said left-hand side of said base die;

b. a flexible die further comprising an upper slot for receiving said upper register tab and a lower slot for receiving said lower register tab; and c. and an upstanding register bar on an outer left-hand edge of said flexible die and to the left of said upper slot and to the left of said lower slot.

* * * * *